US007731401B2

(12) United States Patent
King et al.

(10) Patent No.: US 7,731,401 B2
(45) Date of Patent: Jun. 8, 2010

(54) HIGH EFFICIENCY AUTOMOTIVE LED OPTICAL SYSTEM

(75) Inventors: Robert Lee King, Seymour, IN (US); Dennis Wilkerson, Freetown, IN (US); Dennis Black, Brownstown, IN (US)

(73) Assignee: Valeo Sylvania LLC., Seymour, IN (US)

( * ) Notice: Subject to any disclaimer, the term of this patent is extended or adjusted under 35 U.S.C. 154(b) by 387 days.

(21) Appl. No.: 11/786,232

(22) Filed: Apr. 11, 2007

(65) Prior Publication Data

US 2008/0094852 A1 Apr. 24, 2008

Related U.S. Application Data

(60) Provisional application No. 60/854,011, filed on Oct. 24, 2006.

(51) Int. Cl.
*F21S 8/101* (2006.01)

(52) U.S. Cl. ..... 362/545; 362/543; 362/326; 362/329; 362/334; 362/335

(58) Field of Classification Search ..... 362/545, 362/543, 326, 327, 328, 329, 334, 335
See application file for complete search history.

(56) References Cited

U.S. PATENT DOCUMENTS

| | | | | |
|---|---|---|---|---|
| 6,986,593 | B2 | 1/2006 | Rhoads | |
| 7,249,877 | B2 * | 7/2007 | Johnson et al. | 362/545 |
| 2003/0156416 | A1 * | 8/2003 | Stopa et al. | 362/294 |

FOREIGN PATENT DOCUMENTS

| | | | |
|---|---|---|---|
| DE | 19704467 | A1 | 8/1998 |
| EP | 1270324 | A2 | 1/2003 |
| WO | WO 2004031649 | A1 | 4/2004 |

* cited by examiner

*Primary Examiner*—Jong-Suk (James) Lee
*Assistant Examiner*—Mark Tsidulko
(74) *Attorney, Agent, or Firm*—Edward S. Podszus

(57) ABSTRACT

An exterior automotive lamp may be formed with LED light sources by efficiently using the available light. The LEDs are arranged in an array to illuminate a central lens to produce the horizontal spread from the central portion of the LED beam. Meanwhile a reflector gathers the more disperse side-emitted portion of the LED beam and directs that light as an outer sheath to form a supplementary portion of the beam. The lamp efficiently provides a beam that may be adapted for high-beam, lowbeam, fog, or signal purposes.

25 Claims, 5 Drawing Sheets

HIGH EFFICIENCY AUTOMOTIVE LED OPTICAL SYSTEM

CROSS-REFERENCE TO RELATED APPLICATIONS

The Applicants hereby claim the benefit of their provisional application, Ser. No. 60/854,011 filed Oct. 24, 2006 High Efficiency Automotive LED Optical System.

BACKGROUND OF THE INVENTION

1. Field of the Invention

The invention relates to electric lamps and particularly to automotive lamps. More particularly the invention is concerned with automotive lamps using light emitting diodes as light sources.

2. Description of the Related Art Including Information Disclosed Under 37 CFR 1.97 and 1.98

BRIEF SUMMARY OF THE INVENTION

A high efficiency automotive LED optical system can be made with a reflector with a reflective inner surface defining a cavity with an open end facing a field to be illuminated. The reflective surface includes at least a parabolic reflector portion having a focal point. An LED light source array is positioned to emit light into the cavity and arrayed to project light horizontally about a lamp axis directed towards the field to be illuminated. The LED light source array includes one or more LEDs arrayed horizontally. The LED light source array is positioned to span the focal point. A light transmissive, refractive inner lens is positioned axially and intermediate the LED light source array and the field to be illuminated; and is positioned intermediate the reflector and the field to be illuminated. The inner lens is sized and positioned to intercept less than all of the light emitted by the LED light source array; and the reflector is positioned to intercept the remaining light emitted by the LED light source array. The inner lens has a front optical surface having a vertical cross section, and a rear optical surface having a vertical cross section such that the lens refracts light received by the rear optical surface from the LED light source array and projected from the front optical surface to within plus or minus 5 degrees of a horizontal plane through the lamp. The front optical surface has a horizontal cross section, and the rear optical surface has a horizontal cross section such that the lens refracts light received by the rear optical surface from the LED light source array and projected from the front optical surface spread horizontally from the axis. The reflector directs the remaining intercepted light from the LED light source array to provide a supplementary horizontal pattern.

DETAILED DESCRIPTION OF THE INVENTION

Figure 1:
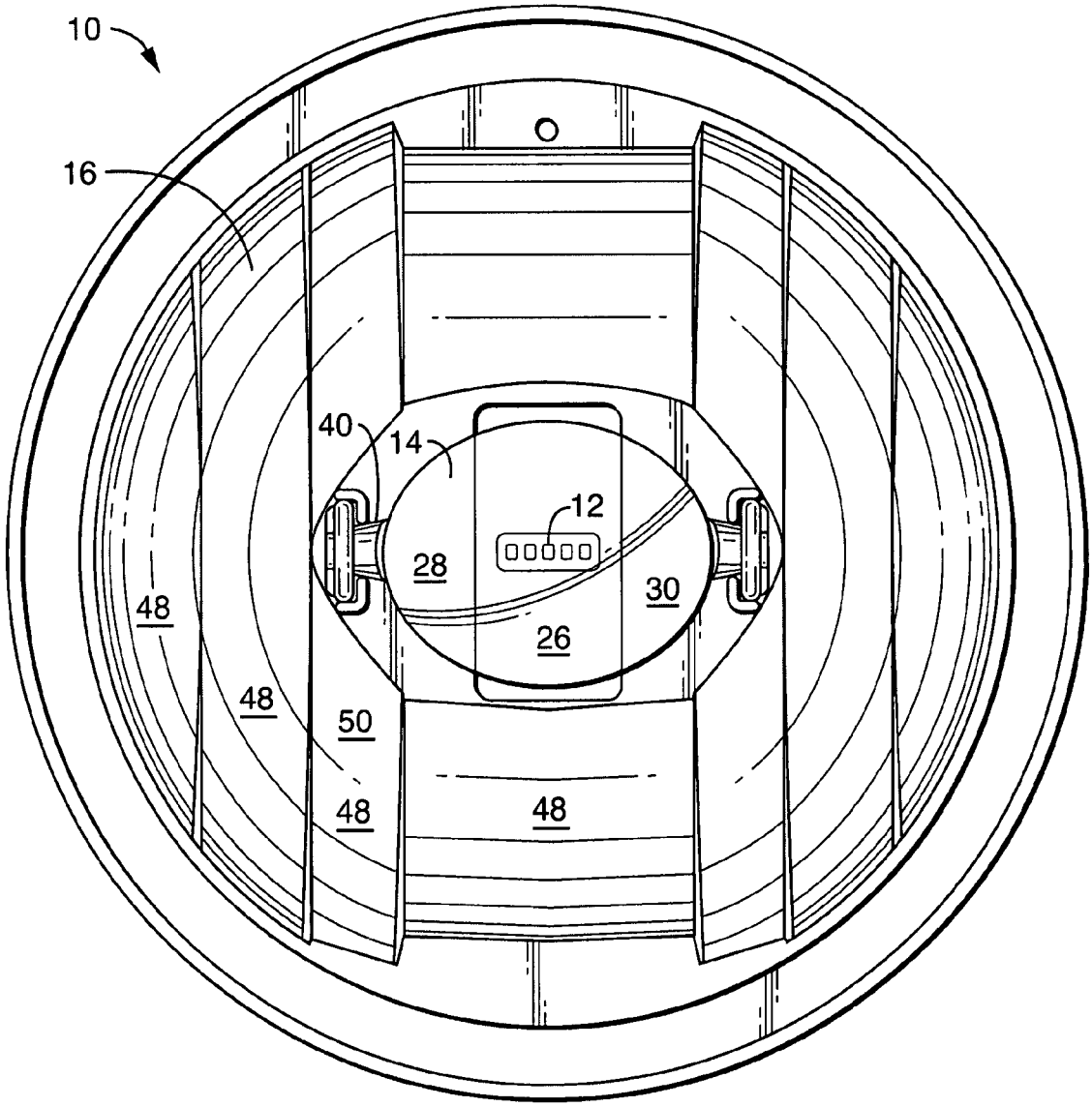
FIG. 1 shows a schematic front view of an automotive LED optical system.
Figure 2:
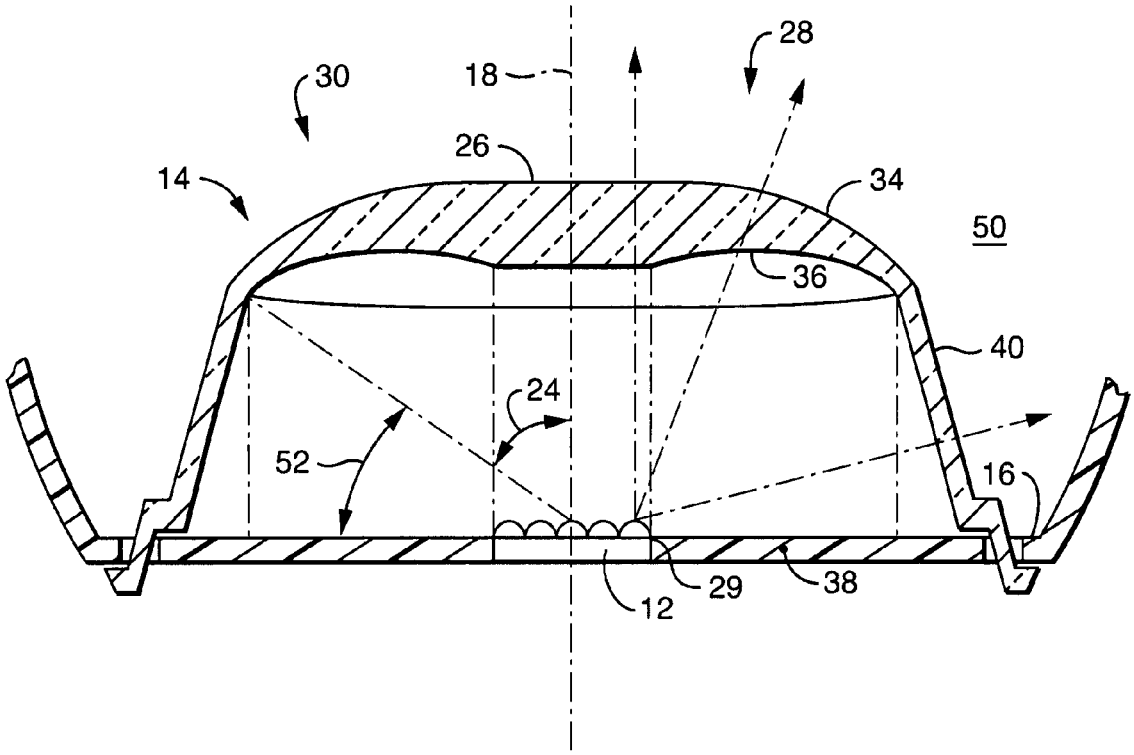
FIG. 2 shows a schematic top view of a horizontal axial cross section of an inner lens.
Figure 3:
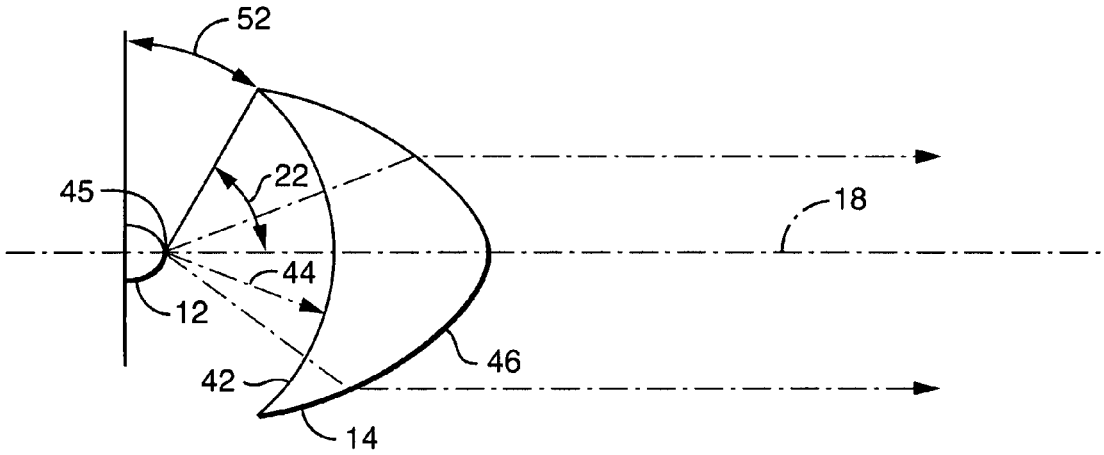
FIG. 3 shows a schematic side view of a vertical axial cross section of an inner lens.
Figure 4:
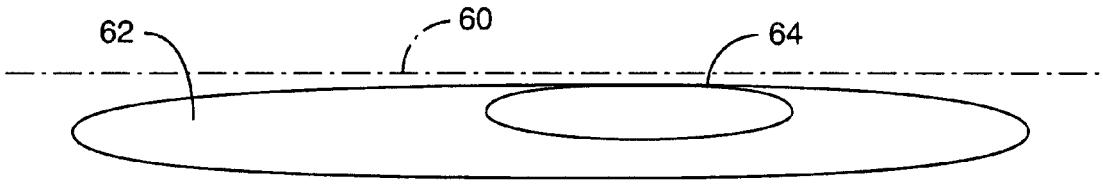
FIG. 4 shows a schematic low beam light pattern.

FIG. 1 shows a schematic front view of a high efficiency automotive LED optical system 10. FIG. 2 shows a schematic top view of an axial cross section of an inner lens. FIG. 3 shows a schematic side view of an axial cross section of an inner lens. The high efficiency automotive LED optical system 10 comprises an LED light source array 12, an inner lens 14 and a reflector 16.

The LED light source array 12 may be a single LED light source or an array of plural LED light sources. The LED light source array 12 emits light with a distribution about a lamp axis 18, and generally towards a field to be illuminated. The LED light source array 12 is specifically positioned to emit light toward the inner lens 14 and the reflector 16, which are in turn aligned to project light horizontally along a lamp axis 18 towards a field to be illuminated. In the preferred embodiment the LED light source array 12 is a horizontal aligned row of closely spaced LEDs, and in particular a horizontal row of five LEDs each facing axially towards the field to be illuminated.

The inner lens 14 is optically configured to substantially refract light received from the LED light source array 12 to be in or to the lower side of a horizontal plane through the lamp assembly 10. The light transmissive, refractive inner lens 14 is positioned axially and intermediate the LED light source array 12 and the field to be illuminated. The inner lens 14 is positioned roughly in front of the LED light source array 12, and offset from the reflector 16 leaving a surrounding gap 52 between the inner lens 14 and the reflector 16. The inner lens 14 is further sized to intercept a large portion, but less than all of the light emitted by the LED light source array 12. In one embodiment the inner lens 14 was sized and positioned to intercept light emitted from the LED light source array 12 that had a vertical angle 22 about the horizontal (positive and negative) of 45 degrees or less (90 degrees total). The inner lens 14 was similarly sized and positioned to intercept light emitted from the LED light source array 12 that had a horizontal angle 24 about the median (positive or negative) of 60 degrees or less (120 degrees total). The inner lens 14 is optically shaped to refract light received from the LED light source array 12 in a horizontal band 62 extending at or below the horizontal. plane 60. The refracted horizontal band 62 forms a substantial portion of a headlamp beam pattern.

FIG. 2 shows a schematic top view of a horizontal, axial cross section of an automotive LED lens 14. The preferred lens 14 has a straight, central section 26 centered on the median, and extending horizontally transverse to the median and lamp axis 18 leading to a right side end 28 and to a left side end 30. The central section 26 extends horizontally sufficiently to orthogonally span the LED light source array 12. The center of the LED emitted beam is then passed substantially straight through the central section 26 towards the field to be illuminated.

The front surface 34 of the right side end 28 is circularly arced about the LED light source array 12 to approach the reflector 16 in the horizontal plane. The circular arc of the right side end of the front surface may be centered any where along the LED light source array, but is preferably centered at the right side end 29 of the LED light source array. It is understood that while actually centered is ideal, an offset of several LED diameters likely to be the practical range of a functional assembly and therefore is acceptable in defining "centered" here. The rear surface 36 of the right side end 28 may be circularly arced about a point between the right end 29 of the LED light source array 12 and the right end of the front surface 34 of the right side of lens orthogonally projected onto the line of the LED light source array 12, for example, midpoint 38. The right side front surface 34 and rear surface 36 then form a right side lens that spreads light to the right.

The lens 14 is further extended on the right side to approach the reflector 16 in the horizontal plane for attachment. The right side end 28 may include a coupling to latch to the reflector 16 or to extend through a passage formed in the reflector 16 to latch to a support in or behind the reflector 16. For example, an approximately axially extending leg 40 formed with a clip coupling formed on an end of the leg 40 may flexibly latch to a hole in the reflector 16. The extended leg 40 portions of the lens 14 may be formed to be resilient, and thereby sufficiently compressible to spring latch in corresponding receptacles formed in the reflector 16 or a similarly convenient support. The left side end 30 of the lens 14 may be similarly formed.

FIG. 3 shows a schematic side view of a vertical, axial cross section of an automotive LED lens. The lens includes a rear surface 42 facing the LED light source array 12. The preferred rear surface 42 of the center portion looking in a vertical plane has the form of a circular radius 44 with the center point of the radius 45 located at, along or adjacent the LED light source array 12 (roughly centered). The lens 14 includes a front surface 46 facing the field to be illuminated. The preferred front surface 46 of the center portion looking in a vertical cross section, has the form of an elliptical section whose major axis is in the horizontal plane, having one foci 45 of the ellipse located at, along or adjacent the LED light source array 12 (again roughly centered).

The front surface 46 of the arced right side (28) of the lens is similarly formed (vertical cross section pivoted from the axis about a point along the LED light source array, such as the end point 29 of the light source array) with an elliptical surface with one foci of the ellipse located at, along or adjacent (roughly centered on) the right side end 29 of the LED light source array 12. In effect, looking at the vertical section, the front optical surface 46 of the central section is dragged around the right side front arc, that is circularly rotated about the LED light source array 12 at the right side end 29 of the lens 14. The preferred left side the lens 14 may be similarly formed (mirrored symmetry).

Figure 5:
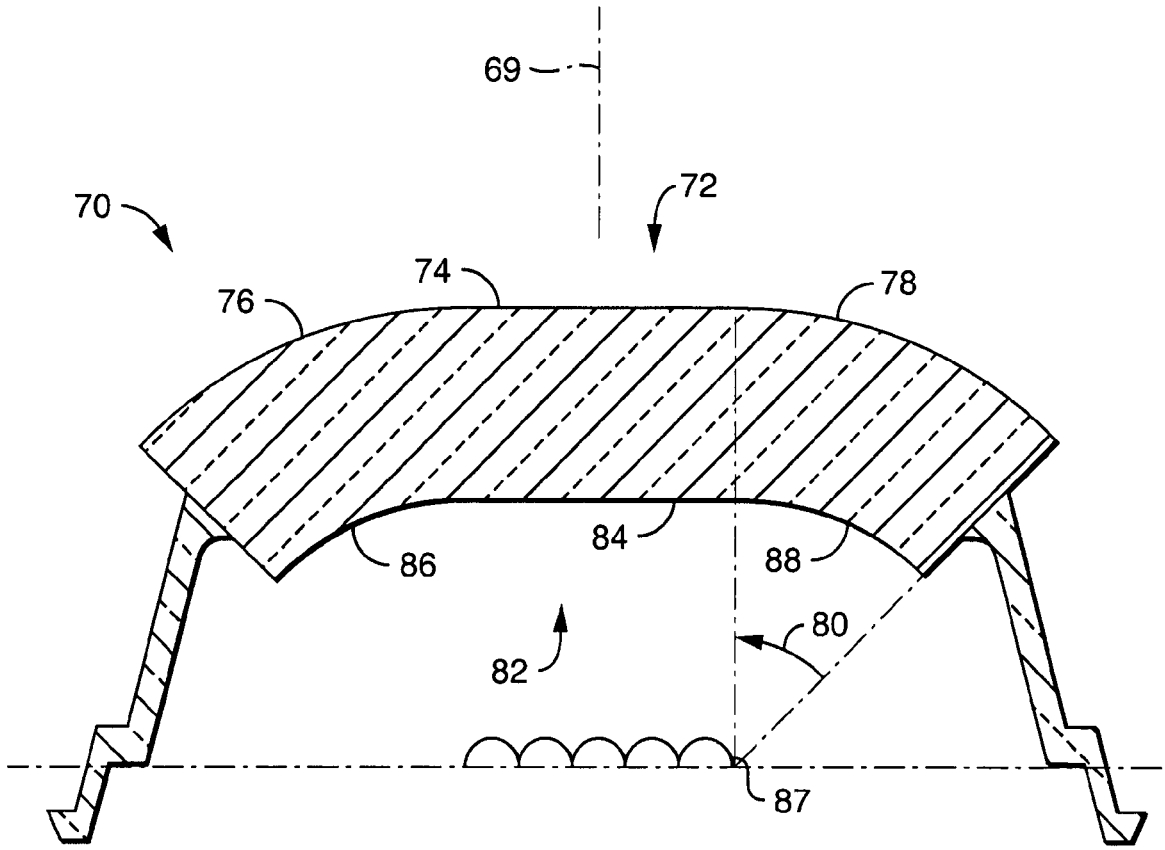
FIG. 5 shows a schematic top view in cross section of an alternative inner lens.

FIG. 5 shows a schematic top view in cross section of an alternative inner lens 70. The front surface 72 is formed the same as in FIG. 2 and 3 with an elliptical section in vertical cross section, and in horizontal cross section a straight central section 74 with circularly arced side sections 76, 78. The side sections 76, 78 are arcs pivoted on the respective ends of the LED light source array through an arc 80 of 45 degrees from the axis 69. The rear surface 82 in vertical cross section is a circular section centered on the LED light source array (the same as radius 44 in FIG. 3). The rear surface 82 in horizontal cross section has a straight central section 84 with circularly arced side sections 86, 88. The side sections 86, 88 are arcs pivoted on the respective side ends of the LED light source array 87 through an arc 80 of 45 degrees from the axis 69. The front surface 72 and rear surface 82 are designed to refract light from the LED light source array into a horizontal plane centered on the LED light source array. Because of the actual LED vertical width, the vertical spread from the horizontal plane may be functionally about 4 or 5 degrees. The front surface 72 and rear surface 82 are designed to spread light from the LED light source horizontally about the axis 69 about plus or minus 45 degrees (90 degrees total). Because of the LED light emitting array width, the horizontal spread from the axial is about 100 degrees.

Figure 6:
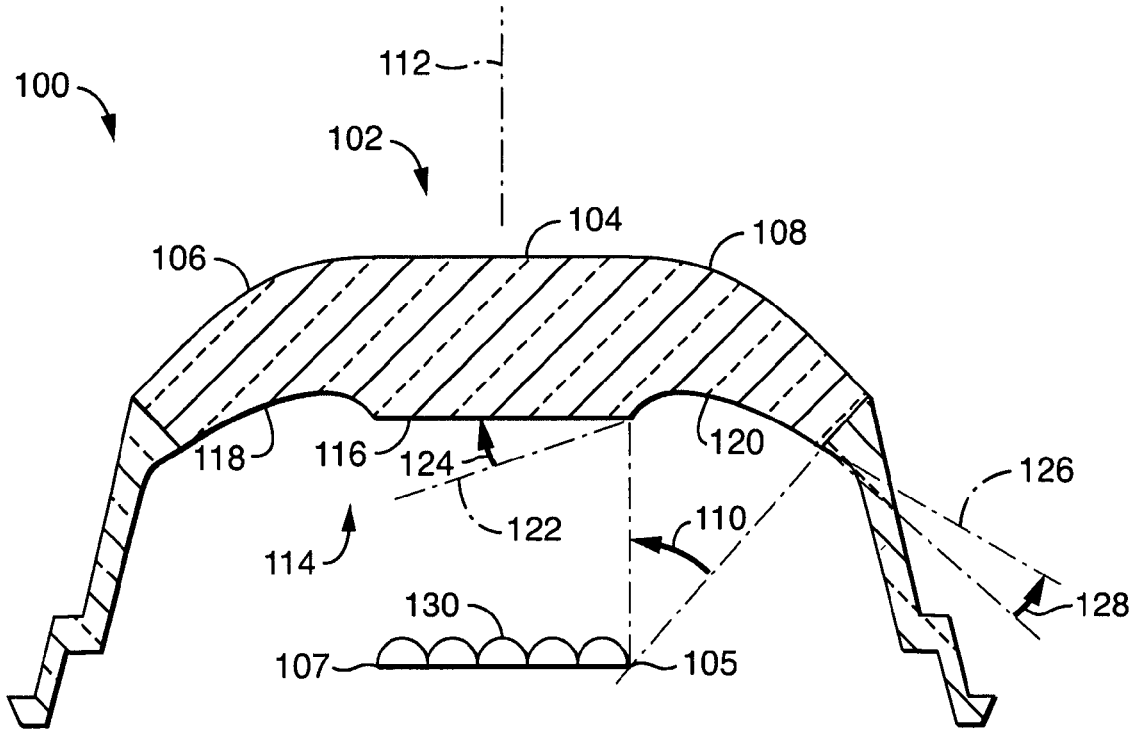
FIG. 6 shows a schematic top view in cross section of an alternative inner lens.

FIG. 6 shows a schematic top view in cross section of an alternative inner lens 100. The front surface 102 is formed the same as in FIGS. 2 and 3 with an elliptical section in vertical cross section, and in horizontal cross section a straight central section 104 with circularly arced side sections 106, 108. The side sections 106, 108 are arcs horizontally pivoted on the respective ends 105, 107 of the LED light source array 130 through an arc 110 of 45 degrees from the axis 112. The rear surface 114 in vertical cross section has a circular section centered on the LED light source array 130, as in FIG. 3. The rear surface 114 in horizontal cross section is a straight central section 116 with B-spline arced side sections 118, 120. A side section 120 is determined by a first drive line 122 having an angle 124 of 18 degrees to the central section 116 (72 degrees from the axis 112), and a second drive line 126 having an angle 128 of 12 degrees to the 45 degree side angle (123 degrees from the axis 112). A B-spline is a continuous arc that is tangent at each respective end to the respective drive line. Intermediate the ends, the B-spline arc has a regular transition from the slope of the first drive line 122 to the slope of the second drive line 126. B-splines are well known in the engineering arts. The front surface 102 and rear surface 114 are designed to refract light from the LED light source array 130 into a horizontal plane centered on the LED light source array 130. Because of the LED vertical width, the vertical spread from the horizontal plane is actually about 4 to 5 degrees. The front surface 102 and rear surface 114 are designed to spread light from the LED light source 130 horizontally about the axis 112 about plus or minus 22.5 degrees (45 degrees total). Because of the LED light emitting array 130 width, the horizontal spread from the axis 112 is about 55 degrees. The inner lens may include additional refractory elements such as an outer ring to blend the lens provided beam and the reflector provided beam.

The reflector 16 has a reflective inner surface 48 defining a cavity 50 with an open end facing along an axis 18 towards the field to be illuminated. The reflector 16 may be molded plastic shell with a metallized reflective surface as is known in the art. The reflector 16 is positioned to surround the inner lens 14, but is offset from the inner lens 14 to provide an optical gap 52 between the inner lens 14 and the reflector 16 through which light emitted by the LED light source array 12 and reflected by the reflector 16 passes. The preferred reflector 16 is sized to intercept a substantial portion, but less than all of the light emitted by the LED light source array 12. The reflector 16 is optically shaped to project light emitted by the LED light source array 12 and intercepted by the reflector 16 in a second pattern different from the first pattern formed by the inner lens 14. Ideally the second pattern is supplementary to the first pattern so the combined patterns form a desired headlamp beam. The preferred reflector 16 is optically shaped to reflect light received from the LED light source array 12 into a supplementary pattern 64 or similar pattern supplementary to the inner lens 14 generated beam pattern, such as the horizontal band 62. The preferred reflector 16 includes one or more optical portions having the form of a section of a paraboloid of revolution 48 that defines a foci. The LED light source array 12 is located at or adjacent the foci. The section of the paraboloid of revolution 48 is oriented to direct light horizontally to form the supplementary beam pattern, such as the supplementary pattern 64 portion of the headlamp beam. It is understood the first pattern and the second pattern may overlap. In the preferred embodiment the reflector 16 includes seven vertical bands, horizontally arrayed, each band being a section of a paraboloid of revolution having a focal point located at or near the light source, thereby yielding a beam pattern spread at or below the horizon line. The preferred seven vertical bands direct light received through the gap 52 between the inner lens 14 and the reflector 16 towards as a supplementary pattern 64 portion of the final beam pattern.

The inner lens 14 then captures the generally forwardly emitted light, perhaps half the emitted LED light, and forms the horizontal spread pattern, emitted from the center or core of the LED light source array 12 beam. The reflector 16 efficiently gathers the generally sideward emitted LED light, and forms the rest of the beam pattern as a sheath coming around the inner lens 14. The reflector 16 generated beam pattern then supplements inner lens 14 generated pattern. Little of the available light is then lost or mis-direct and only one reflection or refraction is need for each emitted ray.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A high efficiency automotive LED optical system comprising:

a reflector having a reflective inner surface defining a cavity with an open end facing a field to be illuminated; the reflective surface including at least a parabolic reflector portion having a focal point;

an LED light source array positioned to emit light into said cavity and arrayed to project light horizontally about a lamp axis directed towards the field to be illuminated; the LED light source array comprising a plurality of LEDs arrayed horizontally, the LED light source array being positioned to span the focal point;

a light transmissive, refractive inner lens positioned axially and intermediate the LED light source array and the field to be illuminated; and positioned intermediate the reflector and the field to be illuminated;

wherein the inner lens is positioned to intercept less than all of the light emitted by the LED light source array;

wherein the reflector is positioned to intercept the remaining light emitted by the LED light source array;

the inner lens with a front optical surface having a vertical cross section, and a rear optical surface having a vertical cross section such that the lens refracts light received by the rear optical surface from the LED light source array and projected from the front optical surface to within plus or minus 4 degrees of a horizontal plane through the lamp;

the front optical surface having a horizontal cross section, and the rear optical surface having a horizontal cross section such that the lens refracts light received by the rear optical surface from the LED light source array and projected from the front optical surface spread horizontally from the axis;

wherein the reflector directs the remaining intercepted light from the LED light source array to provide a supplementary horizontal pattern; and wherein the rear optical surface in vertical cross section includes a central section, wherein the central section includes a circular section centered on the LED light source array; and wherein the rear optical surface in vertical cross section includes a central section, wherein the central section includes a circular section centered on the LED light source array.

2. The LED optical system of claim 1, wherein the rear optical surface in horizontal cross section includes a central section, wherein the central section is horizontally straight, and has a horizontal extension equal to or greater than the horizontal extension of the LED light source array.

3. The LED optical system of claim 1, wherein the front optical surface in horizontal cross section includes a central section, wherein the central section is horizontally straight, and has a horizontal extension equal to or greater than the horizontal extension of the LED light source array.

4. The LED optical system of claim 1, wherein the rear optical surface includes an end section that in vertical cross section includes a section of a circle centered the end of the LED light source array.

5. The LED optical system of claim 1, wherein the plural LEDs are arranged in a single row.

6. The LED optical system of claim 5, wherein the plurality of LEDs is five in number.

7. The LED optical system of claim 1, wherein the inner lens substantially refracts light received from the LED light source array to be substantially on one side of a horizontal plane through the lamp.

8. The LED optical system of claim 1, wherein the inner lens substantially spreads light received from the LED light source array horizontally to be parallel to or below a horizontal plane through the lamp.

9. The LED optical system of claim 1, wherein the reflector surrounds the inner lens and is offset from the inner lens to provide an optical gap between the inner lens and the reflector through which light emitted by the LED light source array and reflected by the reflector passes.

10. The LED optical system of claim 1, wherein the reflector is shaped to project light emitted by the LED light source array and intercepted by the reflector in a pattern different from the pattern formed by the inner lens.

11. The LED optical system of claim 1, wherein the reflector is shaped to project light emitted by the LED light source array and intercepted by the reflector in a headlamp hot spot pattern.

12. The LED optical system of claim 1, wherein the reflector includes a reflective portion having the form of a section of a paraboloid of revolution.

13. The LED optical system of claim 1, wherein one or more reflector portions having the form of a section of a paraboloid of revolution define one or more foci, and the LED light source array is located adjacent the foci.

14. The LED optical system of claim 1, wherein a reflector portion having the form of a section of a paraboloid of revolution defines a reflector axis, and the lamp axis parallels the reflector axis.

15. A high efficiency automotive LED optical system comprising a reflector having a reflective inner surface defining a cavity with an open end facing a field to be illuminated; the reflective surface including at least a parabolic reflector portion having a focal point;

an LED light source array positioned to emit light into said cavity and arrayed to project light horizontally about a lamp axis directed towards the field to be illuminated; the LED light source array comprising a plurality of LEDs arrayed horizontally, the LED light source array being positioned to span the focal point;

a light transmissive, refractive inner lens positioned axially and intermediate the LED light source array and the field to be illuminated; and positioned intermediate the reflector and the field to be illuminated;

wherein the inner lens is positioned to intercept less than all of the light emitted by the LED light source array;

wherein the reflector is positioned to intercept the remaining light emitted by the LED light source array;

the inner lens with a front optical surface having a vertical cross section, and a rear optical surface having a vertical cross section such that the lens refracts light received by the rear optical surface from the LED light source array and projected from the front optical surface to within plus or minus 4 degrees of a horizontal plane through the lamp;

the front optical surface having a horizontal cross section, and the rear optical surface having a horizontal cross section such that the lens refracts light received by the rear optical surface from the LED light source array and projected from the front optical surface spread horizontally from the axis;

wherein the reflector directs the remaining intercepted light from the LED light source array to provide a supplementary horizontal pattern;

wherein the rear optical surface in horizontal cross section includes a central section, wherein the central section is horizontally straight, and has a horizontal extension equal to or greater than the horizontal extension of the LED light source array; and wherein the rear optical surface in horizontal cross section includes an end section, wherein the end section is a section of a circle centered on the horizontal midpoint between the end of the light source array and the perpendicularly projected functional end of the inner lens.

16. A high efficiency automotive LED optical system comprising a reflector having a reflective inner surface defining a cavity with an open end facing a field to be illuminated; the reflective surface including at least a parabolic reflector portion having a focal point;

an LED light source array positioned to emit light into said cavity and arrayed to project light horizontally about a lamp axis directed towards the field to be illuminated; the LED light source array comprising a plurality of LEDs arrayed horizontally, the LED light source array being positioned to span the focal point;

a light transmissive, refractive inner lens positioned axially and intermediate the LED light source array and the field to be illuminated; and positioned intermediate the reflector and the field to be illuminated;

wherein the inner lens is positioned to intercept less than all of the light emitted by the LED light source array;

wherein the reflector is positioned to intercept the remaining light emitted by the LED light source array;

the inner lens with a front optical surface having a vertical cross section, and a rear optical surface having a vertical cross section such that the lens refracts light received by the rear optical surface from the LED light source array and projected from the front optical surface to within plus or minus 4 degrees of a horizontal plane through the lamp;

the front optical surface having a horizontal cross section, and the rear optical surface having a horizontal cross section such that the lens refracts light received by the rear optical surface from the LED light source array and projected from the front optical surface spread horizontally from the axis;

wherein the reflector directs the remaining intercepted light from the LED light source array to provide a supplementary horizontal pattern;

wherein the rear optical surface in horizontal cross section includes a central section, wherein the central section is horizontally straight, and has a horizontal extension equal to or greater than the horizontal extension of the LED light source array; and wherein the rear optical surface in horizontal cross section includes an end section, wherein the end section is a B spline determined from a section of a circle centered on the horizontal midpoint between the end of the light source array and the perpendicularly projected functional end of the inner lens.

17. A high efficiency automotive LED optical system comprising a reflector having a reflective inner surface defining a cavity with an open end facing a field to be illuminated; the reflective surface including at least a parabolic reflector portion having a focal point;

an LED light source array positioned to emit light into said cavity and arrayed to project light horizontally about a lamp axis directed towards the field to be illuminated; the LED light source array comprising a plurality of LEDs arrayed horizontally, the LED light source array being positioned to span the focal point;

a light transmissive, refractive inner lens positioned axially and intermediate the LED light source array and the field to be illuminated; and positioned intermediate the reflector and the field to be illuminated;

wherein the inner lens is positioned to intercept less than all of the light emitted by the LED light source array;

wherein the reflector is positioned to intercept the remaining light emitted by the LED light source array;

the inner lens with a front optical surface having a vertical cross section, and a rear optical surface having a vertical cross section such that the lens refracts light received by the rear optical surface from the LED light source array and projected from the front optical surface to within plus or minus 4 degrees of a horizontal plane through the lamp;

the front optical surface having a horizontal cross section, and the rear optical surface having a horizontal cross section such that the lens refracts light received by the rear optical surface from the LED light source array and projected from the front optical surface spread horizontally from the axis;

wherein the reflector directs the remaining intercepted light from the LED light source array to provide a supplementary horizontal pattern;

wherein the front optical surface in horizontal cross section includes a central section, wherein the central section is horizontally straight, and has a horizontal extension equal to or greater than the horizontal extension of the LED light source array; and wherein the front optical surface in horizontal cross section includes an end section, wherein the end section is a section of a circle centered on the horizontal end point of the light source array.

18. A high efficiency automotive LED optical system comprising a reflector having a reflective inner surface defining a cavity with an open end facing a field to be illuminated; the reflective surface including at least a parabolic reflector portion having a focal point;

an LED light source array positioned to emit light into said cavity and arrayed to project light horizontally about a lamp axis directed towards the field to be illuminated; the LED light source array comprising a plurality of LEDs arrayed horizontally, the LED light source array being positioned to span the focal point;

a light transmissive, refractive inner lens positioned axially and intermediate the LED light source array and the field to be illuminated; and positioned intermediate the reflector and the field to be illuminated;

wherein the inner lens is positioned to intercept less than all of the light emitted by the LED light source array;

wherein the reflector is positioned to intercept the remaining light emitted by the LED light source array;

the inner lens with a front optical surface having a vertical cross section, and a rear optical surface having a vertical cross section such that the lens refracts light received by the rear optical surface from the LED light source array and projected from the front optical surface to within plus or minus 4 degrees of a horizontal plane through the lamp;

the front optical surface having a horizontal cross section, and the rear optical surface having a horizontal cross section such that the lens refracts light received by the rear optical surface from the LED light source array and projected from the front optical surface spread horizontally from the axis;

wherein the reflector directs the remaining intercepted light from the LED light source array to provide a supplementary horizontal pattern; and wherein the rear optical surface includes an end section that in horizontal cross section includes a section of a circle centered at the end of the LED light source array.

19. A high efficiency automotive LED optical system comprising a reflector having a reflective inner surface defining a cavity with an open end facing a field to be illuminated; the reflective surface including at least a parabolic reflector portion having a focal point;

an LED light source array positioned to emit light into said cavity and arrayed to project light horizontally about a lamp axis directed towards the field to be illuminated; the LED light source array comprising a plurality of LEDs arrayed horizontally, the LED light source array being positioned to span the focal point;

a light transmissive, refractive inner lens positioned axially and intermediate the LED light source array and the field to be illuminated; and positioned intermediate the reflector and the field to be illuminated;

wherein the inner lens is positioned to intercept less than all of the light emitted by the LED light source array;

wherein the reflector is positioned to intercept the remaining light emitted by the LED light source array;

the inner lens with a front optical surface having a vertical cross section, and a rear optical surface having a vertical cross section such that the lens refracts light received by the rear optical surface from the LED light source array and projected from the front optical surface to within plus or minus 4 degrees of a horizontal plane through the lamp;

the front optical surface having a horizontal cross section, and the rear optical surface having a horizontal cross section such that the lens refracts light received by the rear optical surface from the LED light source array and projected from the front optical surface spread horizontally from the axis;

wherein the reflector directs the remaining intercepted light from the LED light source array to provide a supplementary horizontal pattern; and wherein the front optical surface in vertical cross section includes a section of an ellipse having a focal point centered at the LED light source array.

20. The LED optical system of claim 19, wherein the front optical surface includes an end section, wherein the end section in vertical cross section includes a section of an ellipse with a focal point centered at the LED light source array, pivoted about the end of the LED light source array.

21. A high efficiency automotive LED optical system comprising a reflector having a reflective inner surface defining a cavity with an open end facing a field to be illuminated; the reflective surface including at least a parabolic reflector portion having a focal point;

an LED light source array positioned to emit light into said cavity and arrayed to project light horizontally about a lamp axis directed towards the field to be illuminated; the LED light source array comprising a plurality of LEDs arrayed horizontally, the LED light source array being positioned to span the focal point;

a light transmissive, refractive inner lens positioned axially and intermediate the LED light source array and the field to be illuminated; and positioned intermediate the reflector and the field to be illuminated;

wherein the inner lens is positioned to intercept less than all of the light emitted by the LED light source array;

wherein the reflector is positioned to intercept the remaining light emitted by the LED light source array;

the inner lens with a front optical surface having a vertical cross section, and a rear optical surface having a vertical cross section such that the lens refracts light received by the rear optical surface from the LED light source array and projected from the front optical surface to within plus or minus 4 degrees of a horizontal plane through the lamp;

the front optical surface having a horizontal cross section, and the rear optical surface having a horizontal cross section such that the lens refracts light received by the rear optical surface from the LED light source array and projected from the front optical surface spread horizontally from the axis;

wherein the reflector directs the remaining intercepted light from the LED light source array to provide a supplementary horizontal pattern; and wherein the inner lens is a circular cylinder with a lens axis horizontally aligned.

22. The LED optical system of claim 21, wherein the inner lens lens axis is arced in the horizontal.

23. The LED optical system of claim 21, wherein the inner lens lens axis is transverse to the lamp axis.

24. A high efficiency automotive LED optical system comprising:

a reflector having a reflective inner surface defining a cavity with an open end facing a field to be illuminated;

an LED light source array being an array of plural LED light sources positioned to emit light into said cavity and arrayed to project light horizontally along a lamp axis direction towards the field to be illuminated; the LED light source array emitting light with a distribution about the axis;

a light transmissive, refractive inner lens positioned axially and intermediate the LED light source array and the field to be illuminated; and positioned intermediate the reflector and the field to be illuminated;

wherein the inner lens is sized to intercept less than all of the light emitted by the LED light source array;

the inner lens substantially refracts light received from the LED light source array to be substantially in or on one side of a horizontal plane through the axis;

the inner lens having a front surface with a central section horizontally spanning the LED light source array, and having a vertical cross section including a section of an ellipse with a focal point centered on the LED light source array, the front surface having a side section that in horizontal cross section includes a section of a circular arc centered on an end of the LED light source array;

the inner lens having a rear surface with a central section horizontally spanning the LED light source array, and having a vertical cross section including a section of a circular arc centered on the LED light source array, the rear surface having a side section that in horizontal cross section includes a section of a circular arc centered on an end of the LED light source array;

the reflector surrounds the inner lens and is offset from the inner lens to provide an optical gap between the inner lens and the reflector through which light emitted by the LED light source array and reflected by the reflector passes;

wherein the reflector is sized to intercept less than all of the light emitted by the LED light source array;

the reflector is shaped to project light emitted by the LED light source array and intercepted by the reflector in a pattern different from the pattern formed by the inner lens;

wherein the reflector surrounds the inner lens and is offset from the inner lens to provide an optical gap between the inner lens and the reflector through which light emitted by the LED light source array and reflected by the reflector passes; and reflector portion having the form of a paraboloid of revolution defines a foci, and the LED light source array is located adjacent the foci.

25. A high efficiency automotive LED optical system comprising a reflector having a reflective inner surface defining a cavity with an open end facing a field to be illuminated; the reflective surface including at least a parabolic reflector portion having a focal point;

an LED light source array positioned to emit light into said cavity and arrayed to project light horizontally about a lamp axis directed towards the field to be illuminated; the LED light source array comprising a plurality of LEDs arrayed horizontally, the LED light source array being positioned to span the focal point;

a light transmissive, refractive inner lens positioned axially and intermediate the LED light source array and the field to be illuminated; and positioned intermediate the reflector and the field to be illuminated;

wherein the inner lens is positioned to intercept less than all of the light emitted by the LED light source array;

wherein the reflector is positioned to intercept the remaining light emitted by the LED light source array;

the inner lens with a front optical surface having a vertical cross section, and a rear optical surface having a vertical cross section such that the lens refracts light received by the rear optical surface from the LED light source array and projected from the front optical surface to within plus or minus 4 degrees of a horizontal plane through the lamp;

the front optical surface having a horizontal cross section, and the rear optical surface having a horizontal cross section such that the lens refracts light received by the rear optical surface from the LED light source array and projected from the front optical surface spread horizontally from the axis;

wherein the reflector directs the remaining intercepted light from the LED light source array to provide a supplementary horizontal pattern; and wherein the inner lens front optical surface has, in the vertical cross section, a section of an ellipse with a focal point centered on the LED light source array and has, in the horizontal cross section, a straight central section and one or more circularly arced respective end portions, and wherein the inner lens rear optical surface has, in the vertical cross section, a circular section centered on or adjacent the LED light source array and has, in the horizontal cross section, a generally straight central section and one or more arced respective end portions centered on a portion of the LED light source array.

* * * * *